US007056232B2

(12) United States Patent
Maruko et al.

(10) Patent No.: US 7,056,232 B2
(45) Date of Patent: Jun. 6, 2006

(54) MULTI-PIECE SOLID GOLF BALL

(75) Inventors: Takashi Maruko, Chichibu (JP); Michio Inoue, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/411,128

(22) Filed: Apr. 11, 2003

(65) Prior Publication Data

US 2003/0190978 A1 Oct. 9, 2003

Related U.S. Application Data

(62) Division of application No. 09/891,654, filed on Jun. 27, 2001.

(30) Foreign Application Priority Data

Jun. 30, 2000 (JP) ..... 2000-197791

(51) Int. Cl.
*A63B 37/06* (2006.01)

(52) U.S. Cl. ..... 473/371; 473/365; 473/374

(58) Field of Classification Search ..... 473/374, 473/378, 373, 351, 361, 365
See application file for complete search history.

(56) References Cited

U.S. PATENT DOCUMENTS

| | | | | |
|---|---|---|---|---|
| 4,431,193 | A | | 2/1984 | Nesbitt |
| 5,184,828 | A | | 2/1993 | Kim et al. |
| 5,253,871 | A | | 10/1993 | Viollaz |
| 5,334,673 | A | | 8/1994 | Wu |
| 5,452,898 | A | * | 9/1995 | Yamagishi et al. ..... 473/377 |
| 5,556,098 | A | | 9/1996 | Higuchi et al. |
| 5,628,699 | A | | 5/1997 | Maruko et al. |
| 5,674,137 | A | | 10/1997 | Maruko et al. |
| 5,704,854 | A | | 1/1998 | Higuchi et al. |
| 5,803,831 | A | | 9/1998 | Sullivan et al. |
| 5,816,937 | A | | 10/1998 | Shimosaka et al. |
| 5,830,085 | A | | 11/1998 | Higuchi et al. |
| 5,836,833 | A | * | 11/1998 | Shimosaka et al. ..... 473/365 |
| 5,872,185 | A | * | 2/1999 | Ichikawa et al. ..... 525/93 |
| 6,106,415 | A | | 8/2000 | Masutani et al. |
| 6,334,819 | B1 | | 1/2002 | Ichikawa et al. |
| 6,716,117 | B1 | | 4/2004 | Ichikawa et al. |

FOREIGN PATENT DOCUMENTS

| | | |
|---|---|---|
| JP | 4-244174 | 9/1992 |
| JP | 6-23069 | 2/1994 |
| JP | 7-24084 | 1/1995 |
| JP | 9-10358 | 1/1997 |
| JP | 9-313643 | 12/1997 |
| JP | 11-137726 A | 5/1999 |

* cited by examiner

*Primary Examiner*—Glenn Caldarola
*Assistant Examiner*—Tom P. Duong
(74) *Attorney, Agent, or Firm*—Sughrue Mion, PLLC

(57) ABSTRACT

In a multi-piece solid golf ball comprising a solid core, an intermediate layer, and a cover, the intermediate layer has a gage $G_1$ of 0.8–2 mm and a Shore D hardness of 50–65, the cover has a gage $G_2$ of 0.5–1.3 mm and a Shore D hardness of 37–53, and the intermediate layer gage $G_1$ and the cover gage $G_2$ satisfy $[G_1/(G_1+G_2)]\times 100 \geqq 45\%$. Upon full shots with a driver, the ball gains a reduced spin rate and an increased initial velocity, which lead to an increase in travel distance.

6 Claims, 2 Drawing Sheets

MULTI-PIECE SOLID GOLF BALL

This application is a division of U.S. application Ser. No. 09/891,654 filed on Jun. 27, 2001.

This invention relates to a multi-piece solid golf ball of three or more layer structure comprising a solid core of at least one layer, an intermediate layer, and a cover.

BACKGROUND OF THE INVENTION

Many two-piece solid golf balls are known in the art. As compared with the wound golf balls, the two-piece solid golf balls have the advantage of an increased total flight distance on both driver and iron shots, because of a so-called straight liner trajectory and a low spin receptivity due to their structure, which allows for a long run. On the other hand, the two-piece solid golf balls are more difficult to control than the wound golf balls in that they do not stop short on the green because of low spin receptivity on iron shots.

Like flight distance, a soft feel when hit is essential for golf balls. The absence of a soft feel represents a substantial loss of commodity value. As compared with the two-piece solid golf balls, the wound golf balls have the structural characteristics ensuring a soft and pleasant feel.

On two-piece solid golf balls consisting of a core and a cover, attempts have been made to soften the ball structure in order to accomplish a soft feel upon impact. A soft core is often used to obtain such soft-feel two-piece solid golf balls, but making the core softer lowers the resilience of the golf ball, compromises flight performance, and also markedly reduces durability. As a result, not only do these balls lack the excellent flight performance and durability characteristic of ordinary two-piece solid golf balls, but they are often in fact unfit for actual use.

Various three-piece solid golf balls in which an intermediate layer is situated between a solid core and a cover have been proposed to resolve these problems as disclosed, for example, in JP-A 7-24084, JP-A 6-23069, JP-A 4-244174, JP-A 9-10358, JP-A 9-313643, U.S. Pat. Nos. 4,431,193, 5,733,206 and 5,803,831.

Golf balls having the cover and the intermediate layer made soft according to these proposals have a soft feel, but a shorter flight distance on full shots with a driver. To insure distance, the cover and the intermediate layer must be formed hard at the sacrifice of the feel upon approach shots and putting. The spin performance on iron shots is also aggravated.

Although a number of proposals have been made for finding a good compromise between increased distance upon full shots with a driver and ease of control upon approach shots as discussed above, many golfers desire a further increase of distance. None of prior art solid golf balls fully meet the demands.

SUMMARY OF THE INVENTION

Therefore, an object of the invention is to provide a multi-piece solid golf ball of three or more layer structure comprising a solid core of at least one layer, an intermediate layer, and a cover, which travels a further increased distance upon full shots with a driver.

The invention pertains to a multi-piece solid golf ball of three or more layer structure comprising a solid core of at least one layer, an intermediate layer, and a cover. It has been found that a further increase in travel distance can be accomplished by optimizing the combination of the intermediate layer gage with the cover gage.

An experiment was made on three-piece solid golf balls having a solid core, an intermediate layer of different gage, and a cover of different gage. The balls were hit with a driver at a head speed of 50 m/sec. In the graph of FIG. 1, the initial velocity at which the ball is launched is plotted as a function of the intermediate layer gage for different cover gages. It is found that (1) for an intermediate layer gage in the range of 2.0 to 1.2 mm, the ball is improved in rebound as the gage of intermediate layer and cover combined becomes smaller; and that (2) when the intermediate layer gage is below 1.2 mm, the rebound of the ball declines because the force by which the intermediate layer binds the solid core is reduced. From these findings, it is seen that the rebound reaches a maximum or critical point when the intermediate layer has a gage of about 1.2 mm (as depicted by an arrow in FIG. 1).

A similar experiment was made while setting the head speed at 50, 45 and 40 m/sec. The results are shown in Table 1.

TABLE 1

| Head speed HS (m/sec) | Initial velocity V (m/sec) | ΔV* (m/sec) | (ΔV/V) × 100 (%) |
|---|---|---|---|
| 50 | 72.5 | 0.20 | 0.28 |
| 45 | 66.0 | 0.16 | 0.24 |
| 40 | 58.7 | 0.08 | 0.14 |

*maximum initial velocity difference when the intermediate layer gage and the cover gage are changed.

The initial velocity increasing effect is discussed in conjunction with Table 1. (3) As the head speed increases from 40 m/sec to 45 m/sec, then to 50 m/sec, the ball initial velocity increases and the ball deflection increases. As a consequence, the force by which the intermediate layer or cover binds the solid core is reduced, resulting in more losses. Therefore, the initial velocity increasing effect is also dependent on the head speed.

In conclusion, with respect to the rebound energy or initial velocity increasing effect based on the combination of cover gage with intermediate layer gage, the maximum rebound appears at an intermediate layer gage of about 1.2 mm as shown in FIG. 1. The initial velocity increasing effect is dependent on the head speed as seen from Table 1 and becomes outstanding in a head speed range of 45 m/sec or higher.

Based on the above findings, the inventor has made a further study to reach the present invention. In a multi-piece solid golf ball comprising a solid core of at least one layer, an intermediate layer enclosing the solid core, and a cover enclosing the intermediate layer, selection is made such that the intermediate layer has a gage $G_1$ of 0.8 to 2 mm, preferably 1 to 2 mm and a Shore D hardness of 50 to 65, the cover has a gage $G_2$ of 0.5 to 1.3 mm and a Shore D hardness of 37 to 53, and the gage $G_1$ of the intermediate layer and the gage $G_2$ of the cover satisfy $[G_1/(G_1+G_2)]\times 100 \geqq 45\%$. This selection accomplishes optimization of the combination of the intermediate layer gage with the cover gage. An increase of travel distance is accomplished by the cooperation of a reduced spin rate and an increased launching initial velocity upon full shots with a driver. There is obtained a multi-piece solid golf ball of quality meeting golfers' demands.

Therefore, the invention provides a multi-piece solid golf ball comprising a solid core of at least one layer, an intermediate layer enclosing the solid core, and a cover enclosing the intermediate layer. The intermediate layer has a gage $G_1$ of 0.8 to 2 mm and a Shore D hardness of 50 to 65. The cover has a gage $G_2$ of 0.5 to 1.3 mm and a Shore D hardness of 37 to 53. The gage $G_1$ of the intermediate layer and the gage $G_2$ of the cover satisfy $[G_1/(G_1+G_2)]\times 100 \geqq 45\%$.

Preferably, the solid core undergoes a deflection of 3 to 4.5 mm under an applied load of 100 kg. Preferably, the intermediate layer has a gage $G_1$ of 1 to 2 mm. The cover is preferably formed of a cover material having a melt index of at least 3.0 dg/min at 190° C., and typically a urethane resin.

DESCRIPTION OF THE PREFERRED EMBODIMENTS

Figure 1:
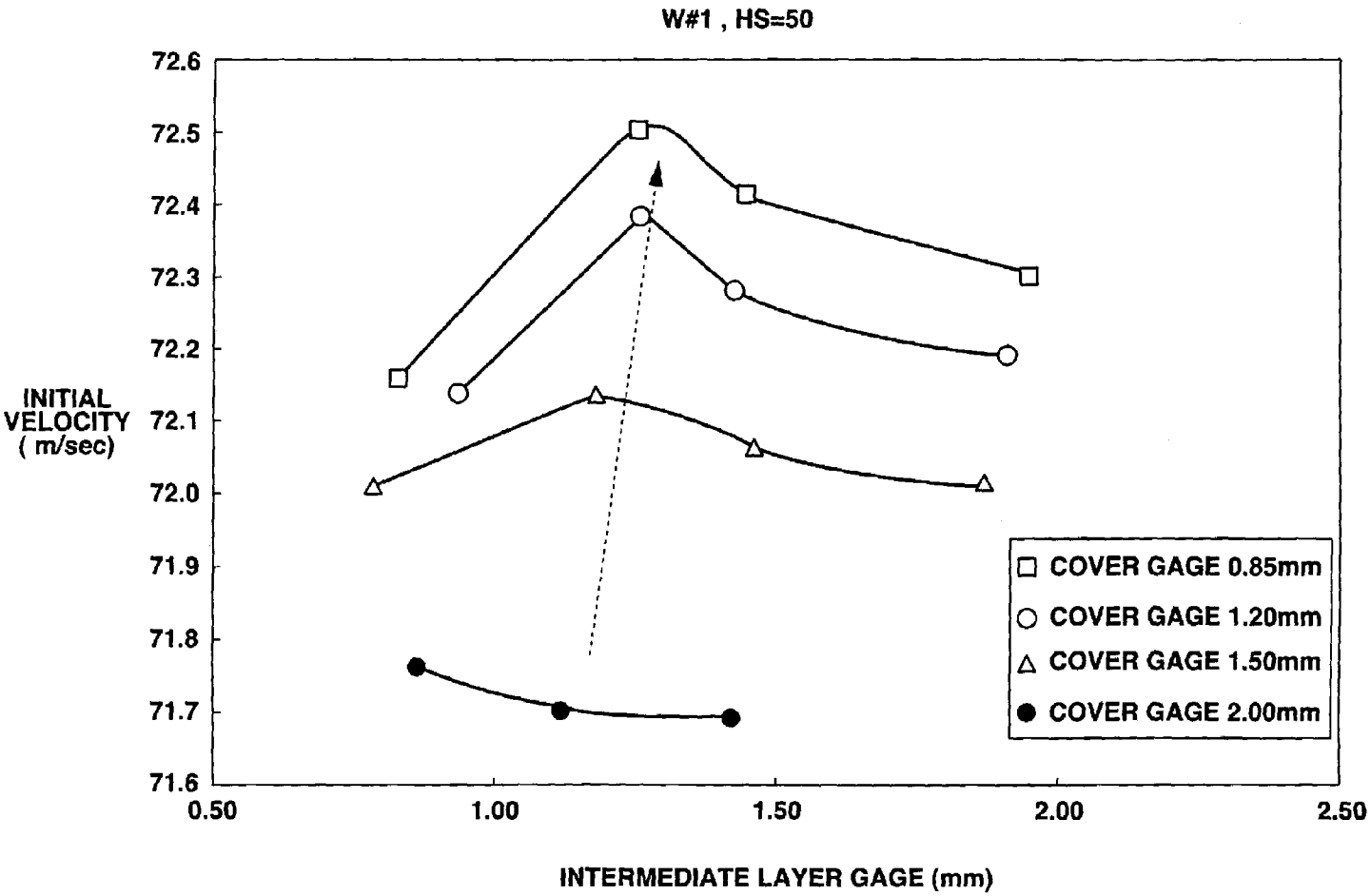
FIG. 1 is a graph showing the initial velocity of balls upon driver shots at a head speed of 50 m/sec as a function of intermediate layer gage and cover gage.
Figure 2:
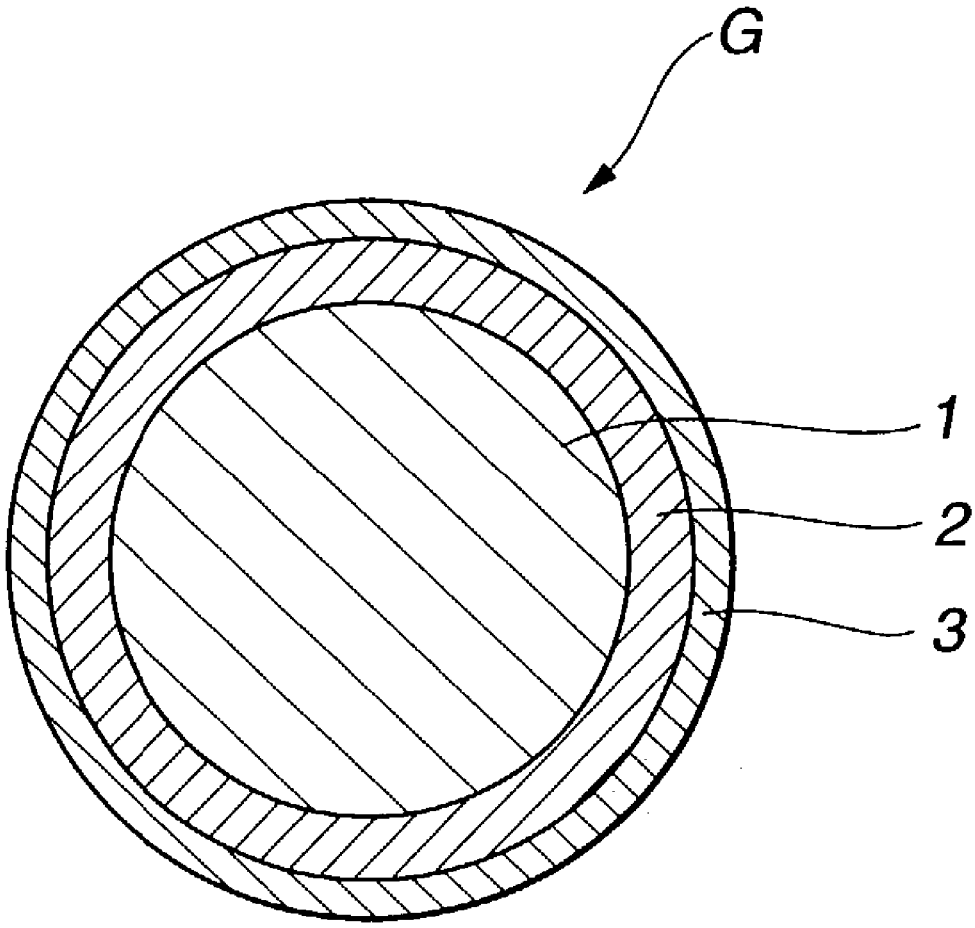
FIG. 2 is a schematic cross-section of a multi-piece solid golf ball according to one embodiment of the invention.

Referring to FIG. 2, a multi-piece solid golf ball G according to the invention is schematically illustrated as comprising a solid core 1, an intermediate layer 2 enclosing the core 1, and a cover 3 enclosing the intermediate layer 2. Each of the solid core 1, intermediate layer 2 and cover 3 consists of one or more layers. That is, the multi-piece solid golf ball is constructed to a three or more layer structure. Though not shown in FIG. 2, a multiplicity of dimples are formed on the surface of the ball.

The solid core 1 may be formed of a rubber composition primarily comprising a base rubber which is based on polybutadiene rubber, polyisoprene rubber, natural rubber or silicone rubber. Polybutadiene rubber is preferred especially for improved resilience. The preferred polybutadiene rubber is cis-1,4-polybutadiene containing at least 40%, especially at least 90% cis structure. In the base rubber, another rubber component such as natural rubber, polyisoprene rubber or styrene-butadiene rubber may be blended with the polybutadiene if desired. Since a higher proportion of polybutadiene is effective for improving the rebound of the golf ball, the other rubber component should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc dimethacrylate and zinc diacrylate, and esters such as trimethylpropane methacrylate. Of these, zinc diacrylate is preferred because it can impart high resilience. The crosslinking agent is preferably used in an amount of about 15 to 40 parts by weight per 100 parts by weight of the base rubber. A vulcanizing agent such as dicumyl peroxide or a mixture of dicumyl peroxide and 1,1-bis(t-butylperoxy)-3,3,5-trimethylcyclohexane may also be blended in the rubber composition, preferably in an amount of about 0.1 to 5 parts by weight per 100 parts by weight of the base rubber. In the rubber composition, an antidegrarant and a specific gravity adjusting filler such as zinc oxide or barium sulfate are blended, if necessary. The amount of filler blended is 0 to about 130 parts by weight per 100 parts by weight of the base rubber.

The core-forming rubber composition is obtained by kneading the above-mentioned components in a conventional mixer such as a kneader, Banbury mixer or roll mill. The resulting compound is molded in a mold by injection or compression molding.

Preferably the solid core has a diameter of 25 to 40 mm, more preferably 30 to 40 mm, and a weight of 10 to 40 g, more preferably 15 to 40 g, and most preferably 20 to 38 g.

Also the solid core should preferably have a deflection $\mu_1$ of 3 to 4.5 mm, more preferably 3 to 4 mm, under an applied load of 100 kg. Too small a core deflection may lead to a hard feel whereas too large a core deflection may correspond to a low resilience.

It is understood that the core may have a single layer structure of a single material or a multilayer structure of two or more stacked layers of different materials.

According to the invention, the intermediate layer 2 of at least one layer, preferably one or two layers, is formed around the core 1.

The material of which the intermediate layer is formed is not critical. A choice may be made among ionomer resins, polyester elastomers, polyamide elastomers, styrene elastomers, polyurethane elastomers, olefin elastomers and mixtures of any, and rubbery materials. Of these, the ionomer resins are especially preferred. Use may be made of commercially available ionomer resins such as "Himilan" from Dupont-Mitsui Polychemical Co. Ltd., "Surlyn" from E. I. Dupont, and "Iotek" from Exxon. If necessary, UV absorbers, antioxidants and dispersants such as metal soaps are added to the intermediate layer-forming material.

Any desired method may be used in forming the intermediate layer around the core. Conventional injection or compression molding may be employed. When the intermediate layer has a gage of at least 1.5 mm, it is preferably formed by injection molding in a conventional mold having gates on the equator plane. When the intermediate layer has a gage of less than 1.5 mm, it is preferably formed by-injection-molding in a special mold having gates at the opposite poles (see U.S. Pat. No. 6,024,551).

The intermediate layer should have a Shore D hardness of 50 to 65, preferably 53 to 62, and more preferably 56 to 58. An intermediate layer with too low a Shore D hardness is too soft, leading to a less resilience, increased spin and reduced distance. An intermediate layer with too high a Shore D hardness is too hard, leading to a hard feel and poor durability.

The intermediate layer should have a gage or radial thickness of 0.8 to 2 mm, preferably 1 to 2 mm, and more preferably 1 to 1.5 mm. Outside the range, an optimum combination cannot be found between the intermediate layer gage and the cover gage, failing to achieve the objects of the invention.

It is noted that the spherical body obtained by enclosing the core with the intermediate layer should preferably have a deflection $\mu_2$ of 2.5 to 6.5 mm, more preferably 2.8 to 6.0 mm, even more preferably 3 to 5 mm, under an applied load of 100 kg.

According to the invention, the cover 3 of at least one layer, preferably one or two layers, is formed around the intermediate layer 2.

The cover is formed mainly of a conventional thermoplastic resin. A choice may be made, for example, among urethane resins, ionomer resins, polyester elastomers, polyamide elastomers, styrene elastomers, polyurethane elastomers, olefin elastomers and mixtures of any. Of these, thermoplastic urethane resins are preferred. Use may be made of commercially available urethane resins such as Pandex (Dainippon Ink & Chemicals, Inc.), Miracton (Nippon Miracton Co., Ltd.), and Esten (Kyowa Hakko Kogyo Co., Ltd.). If necessary, UV absorbers, antioxidants and dispersants such as metal soaps are added to the cover material.

The cover material should preferably have a melt index of at least 3.0 dg/min, more preferably 3.0 to 50 dg/min, even more preferably 5.0 to 40 dg/min, and most preferably 5.0 to 20 dg/min, as measured at 190° C. according to JIS K6760. A resin material with a lower melt index may be less flowable and thus difficult to mold a thin uniform cover.

Any desired method may be used in forming the cover around the intermediate layer. Conventional injection or compression molding may be employed. Since the cover is thin, it is preferably formed by injection molding in a special mold having gates at the opposite poles (see U.S. Pat. No. 6,024,551).

The cover should have a Shore D hardness of 37 to 53, and preferably 40 to 50. A cover with a higher Shore D hardness is too hard, leading to less spin and difficulty of control. A cover with a lower Shore D hardness is too soft, leading to such disadvantages as increased spin and especially, reduced distance on driver shots.

The cover should have a gage or radial thickness of 0.5 to 1.3 mm, preferably 0.5 to 1.0 mm, and more preferably 0.8 to 1.0 mm. Outside the range, an optimum combination cannot be reached between the intermediate layer gage and the cover gage, failing to achieve the objects of the invention.

The invention requires that the gage $G_1$ (mm) of the intermediate layer and the gage $G_2$ (mm) of the cover satisfy $[G_1/(G_1+G_2)]\times100\geqq45\%$. The preferred relationship is $45\%\leqq[G_1/(G_1+G_2)]\times100\leqq70\%$, more preferably $45\%\leqq[G_1/(G_1+G_2)]\times100\leqq65\%$, and even more preferably $50\%\leqq[G_1/(G_1+G_2)]\times100\leqq65\%$.

The specific ranges of the intermediate layer gage and the cover gage and the above relationship ensure an optimum combination of the intermediate layer gage with the cover gage. Then the ball will travel a further increased distance upon full shots with a driver.

It is noted that the spherical body obtained by enclosing the intermediate layer with the cover, that is, the ball as a whole should preferably have a deflection $\mu_3$ of 2.5 to 5.5 mm, more preferably 2.5 to 4.0 mm, under an applied load of 100 kg.

The above-described features cooperate such that the multi-piece solid golf ball of the invention may gain a reduced spin rate and an increased launching initial velocity upon full shots with a driver, accomplishing an increase of travel distance.

The golf ball of the invention is provided on its surface with a multiplicity of dimples. Typically the ball surface is subject to various finish treatments including paint coating and stamping. The golf ball must have a diameter of not less than 42.67 mm and a weight of not greater than 45.93 grams in accordance with the Rules of Golf.

EXAMPLE

Examples of the invention are given below by way of illustration and not by way of limitation. The amounts of ingredients in Tables are parts by weight.

Examples 1–8 & Comparative Examples 1–7

Core-forming rubber compositions of the formulation shown in Table 2 were mixed in a kneader and molded and vulcanized in a core mold at a temperature of 155° C. for 15 minutes, forming solid cores A to D.

TABLE 2

| | Core composition (pbw) | | | |
|---|---|---|---|---|
| | A | B | C | D |
| JSR BR11[1)] | 70 | 70 | 70 | 70 |
| JSR BR19[1)] | 30 | 30 | 30 | 30 |
| Zinc oxide | 15.5 | 17.2 | 19.1 | 22.2 |
| Zinc diacrylate[2)] | 28 | 28 | 28 | 28 |
| Bayer Renacit 7[3)] | 1.0 | 1.0 | 1.0 | 1.0 |
| Zinc stearate | 5.0 | 5.0 | 5.0 | 5.0 |
| Percumyl D[4)] | 0.6 | 0.6 | 0.6 | 0.6 |
| Perhexa 3M[4)] | 0.6 | 0.6 | 0.6 | 0.6 |

[1)]polybutadiene by JSR Co., Ltd.
[2)]Nippon Catalyst Co., Ltd.
[3)]Bayer AG
[4)]peroxide by NOF Co., Ltd.

Around the cores, the intermediate layer and cover were formed by injection molding the intermediate layer compositions and the cover compositions in a combination as shown in Tables 3 and 4. There were obtained three-piece solid golf balls in Examples 1–8 and Comparative Examples 1–7. It is noted that the intermediate layer and the cover were formed by injection molding in a conventional mold having gates on the equator plane when they had a gage of at least 1.5 mm. They were injection molded in a special mold having gates at the opposite poles (see U.S. Pat. No. 6,024,551) when they had a gage of less than 1.5 mm.

| Intermediate layer composition | |
|---|---|
| Himilan 1557 | 5 parts |
| Himilan 1605 | 20 parts |
| Himilan 1855 | 75 parts |
| Shore D hardness | 56 |

They are ionomer resins available from Dupont-Mitsui Polychemical Co., Ltd.

| Cover composition | |
|---|---|
| Pandex TR3080 | 25 parts |
| Pandex T7298 | 75 parts |
| Shore D hardness | 47 |
| Melt index 8.2 dg/min at 190° C. | |

They are thermoplastic urethane resins available from Dainippon Ink & Chemicals Inc.

The golf balls were examined for several properties by the following tests. The results are shown in Tables 3 and 4.

Solid Core Deflection

The deflection (mm) of the solid core under an applied load of 100 kg was measured.

Spherical Body Deflection

The deflection (mm) of the spherical body obtained by enclosing the solid core with the intermediate layer under an applied load of 100 kg was measured.

Ball Deflection

The deflection (mm) of the ball under an applied load of 100 kg was measured.

Flight Performance

A swing robot (by Miyamae K. K.) was equipped with a driver (W#1, Tour Stage X-500, loft angle 90°, by Bridgestone Sports Co., Ltd.). The ball was struck with the driver at a head speed of 45 m/sec (HS 45) and 50 m/sec (HS 50), and the spin rate, initial velocity, launch angle, carry, and total distance were measured.

TABLE 3

| | Example | | | | | | | |
|---|---|---|---|---|---|---|---|---|
| | 1 | 2 | 3 | 4 | 5 | 6 | 7 | 8 |
| Solid core | | | | | | | | |
| Composition | A | A | B | B | C | C | D | D |
| Outer diameter (mm) | 39.31 | 38.54 | 38.5 | 37.79 | 38.07 | 37.34 | 36.95 | 36.34 |
| Weight (g) | 36.2 | 34.1 | 34.3 | 32.4 | 33.5 | 31.6 | 31.1 | 29.6 |
| Deflection (mm) | 3.81 | 3.77 | 3.68 | 3.66 | 3.64 | 3.71 | 3.66 | 3.67 |
| Intermediate layer | | | | | | | | |
| Outer diameter* (mm) | 40.97 | 40.4 | 41.0 | 40.3 | 40.96 | 40.18 | 40.84 | 40.15 |
| Weight* (g) | 40.1 | 38.4 | 40.2 | 38.1 | 40.2 | 37.9 | 39.8 | 37.8 |
| Gage $G_1$ (mm) | 0.83 | 0.93 | 1.25 | 1.25 | 1.44 | 1.42 | 1.95 | 1.91 |
| Shore D hardness | 56 | 56 | 56 | 56 | 56 | 56 | 56 | 56 |
| Deflection* (mm) | 3.55 | 3.46 | 3.31 | 3.31 | 3.25 | 3.30 | 3.16 | 3.11 |
| Cover | | | | | | | | |
| Gage $G_2$ (mm) | 0.86 | 1.14 | 0.85 | 1.17 | 0.86 | 1.25 | 0.92 | 1.27 |
| Shore D hardness | 47 | 47 | 47 | 47 | 47 | 47 | 47 | 47 |
| $G_1/(G_1 + G_2)] \times 100$ (%) | 49.1 | 45 | 59.5 | 51.7 | 62.6 | 53.2 | 67.9 | 60.1 |
| Ball | | | | | | | | |
| Outer diameter (mm) | 42.68 | 42.67 | 42.7 | 42.65 | 42.68 | 42.69 | 42.68 | 42.69 |
| Weight (g) | 45.2 | 45.1 | 45.2 | 45.1 | 45.4 | 45.1 | 45.4 | 45.2 |
| Deflection (mm) | 3.37 | 3.26 | 3.15 | 3.11 | 3.04 | 3.06 | 2.9 | 2.86 |
| W#1/HS = 50 | | | | | | | | |
| Spin (rpm) | 2630 | 2730 | 2660 | 2770 | 2700 | 2810 | 2740 | 2860 |
| Initial velocity (m/sec) | 72.16 | 72.14 | 72.51 | 72.39 | 72.42 | 72.29 | 72.31 | 72.2 |
| Launch angle (°) | 9.75 | 9.66 | 9.7 | 9.67 | 9.71 | 9.61 | 9.62 | 9.57 |
| Carry (m) | 238.8 | 238.5 | 240.8 | 239.7 | 239.5 | 238.7 | 238.0 | 237.7 |
| Total (m) | 253.5 | 253.2 | 255.5 | 254.8 | 254.2 | 253.4 | 252.3 | 252.0 |
| W#1/HS = 45 | | | | | | | | |
| Spin (rpm) | 2780 | 2860 | 2810 | 2910 | 2850 | 2970 | 2900 | 3030 |
| Initial velocity (m/sec) | 65.81 | 65.77 | 65.98 | 65.92 | 65.88 | 65.81 | 65.8 | 65.76 |
| Launch angle (°) | 9.66 | 9.61 | 9.74 | 9.6 | 9.68 | 9.47 | 9.5 | 9.47 |
| Carry (m) | 213.6 | 213.3 | 214.6 | 214.4 | 214.0 | 213.5 | 213.1 | 212.7 |
| Total (m) | 229.6 | 229.2 | 231.8 | 231.0 | 230.3 | 229.5 | 228.7 | 228.4 |

*solid core + intermediate layer

TABLE 4

| | Comparative Example | | | | | | |
|---|---|---|---|---|---|---|---|
| | 1 | 2 | 3 | 4 | 5 | 6 | 7 |
| Solid core | | | | | | | |
| Composition | A | A | B | B | C | C | D |
| Outer diameter (mm) | 38.07 | 36.98 | 37.34 | 36.38 | 36.69 | 35.78 | 35.78 |
| Weight (g) | 32.9 | 30.1 | 31.3 | 28.9 | 29.9 | 27.8 | 28.2 |
| Deflection (mm) | 3.72 | 3.81 | 3.72 | 3.76 | 3.8 | 3.77 | 3.72 |
| Intermediate layer | | | | | | | |
| Outer diameter* (mm) | 39.63 | 38.69 | 39.69 | 38.63 | 39.61 | 38.63 | 39.52 |
| Weight* (g) | 36.3 | 33.7 | 36.4 | 33.6 | 36.2 | 33.6 | 36.0 |
| Gage $G_1$ (mm) | 0.78 | 0.86 | 1.18 | 1.12 | 1.46 | 1.42 | 1.87 |
| Shore D hardness | 56 | 56 | 56 | 56 | 56 | 56 | 56 |
| Deflection* (mm) | 3.53 | 3.55 | 3.46 | 3.47 | 3.47 | 3.41 | 3.29 |
| Cover | | | | | | | |
| Gage $G_2$ (mm) | 1.52 | 1.99 | 1.51 | 2.02 | 1.54 | 2.02 | 1.59 |
| Shore D hardness | 47 | 47 | 47 | 47 | 47 | 47 | 47 |
| $[G_1(G_1 + G_2)] \times 100$ (%) | 33.9 | 30.2 | 43.9 | 35.7 | 48.7 | 41.3 | 53.6 |
| Ball | | | | | | | |
| Outer diameter (mm) | 42.68 | 42.68 | 42.71 | 42.67 | 42.68 | 42.67 | 42.69 |
| Weight (g) | 45.2 | 45.2 | 45.2 | 45.3 | 45.2 | 45.3 | 45.3 |
| Deflection (mm) | 3.25 | 3.17 | 3.09 | 3.06 | 3.05 | 2.96 | 2.86 |

TABLE 4-continued

| | Comparative Example | | | | | | |
|---|---|---|---|---|---|---|---|
| | 1 | 2 | 3 | 4 | 5 | 6 | 7 |
| W#1/HS = 50 | | | | | | | |
| Spin (rpm) | 2840 | 2970 | 2870 | 2990 | 2900 | 3010 | 2940 |
| Initial velocity (m/sec) | 72.01 | 71.76 | 72.14 | 71.7 | 72.07 | 71.69 | 72.02 |
| Launch angle (°) | 9.49 | 9.41 | 9.63 | 9.48 | 9.57 | 9.53 | 9.5 |
| Carry (m) | 237.3 | 236.2 | 238.0 | 236.8 | 237.6 | 236.7 | 237.0 |
| Total (in) | 251.0 | 249.8 | 251.2 | 249.5 | 250.5 | 250.0 | 249.9 |
| W#1/HS = 45 | | | | | | | |
| Spin (rpm) | 2940 | 3050 | 2980 | 3090 | 3050 | 3130 | 3110 |
| Initial velocity (m/sec) | 65.66 | 65.39 | 65.74 | 65.35 | 65.69 | 65.33 | 65.69 |
| Launch angle (°) | 9.42 | 9.33 | 9.56 | 9.38 | 9.39 | 9.3 | 9.31 |
| Carry (m) | 212.0 | 211.4 | 212.7 | 212.1 | 212.4 | 211.8 | 212.0 |
| Total (m) | 227.5 | 226.4 | 228.0 | 226.9 | 227.5 | 226.5 | 227.0 |

*solid core + intermediate layer

There has been described a multi-piece solid golf ball of quality having an optimum combination of the intermediate layer gage with the cover gage, which travels a further increased distance upon full shots with a driver, owing to a reduced spin rate and an increased launching initial velocity.

Japanese Patent Application No. 2000-197791 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball consisting of a solid core of one layer, an intermediate layer enclosing the solid core, and a cover enclosing the intermediate layer, wherein the cover is formed of thermoplastic urethane resins, said intermediate layer has a gage $G_1$ of 0.8 to 1.5 mm and a Shore D hardness of 53 to 65, said cover has a gage $G_2$ of 0.5 to 1.3 mm and a Shore D hardness of 37 to 53, which is softer than said intermediate layer, and the gage $G_1$ of said intermediate layer and the gage $G_2$ of said cover satisfy $67.9\% \geqq [G_1/(G_1+G_2)] \times 100 \geqq 51.7\%$, and wherein said solid core, a spherical body obtained by enclosing the core with the intermediate layer and a spherical body obtained by enclosing the intermediate layer with the cover undergo a deflection of 3 to 4.5 mm, 2.8 to 6.0 mm and 2.5 to 4.0 mm under an applied load of 100 kg, respectively, and provided that the deflection of the solid core is $\mu_1$, the deflection of the spherical body obtained by enclosing the core with the intermediate layer is $\mu_2$ and the deflection of the spherical body obtained by enclosing the intermediate layer with the cover is $\mu_3$, these deflections are satisfied as a following relationship;

$$\mu_1 > \mu_2 > \mu_3.$$

2. The multi-piece solid golf ball of claim 1 wherein said intermediate layer has a gage $G_1$ of 1 to 1.5 mm.

3. The multi-piece solid golf ball of claim 1 wherein said cover is formed of a cover material having a melt index of at least 3.0 dg/min at 190° C.

4. The multi-piece solid golf ball of claim 1, wherein the Shore D hardness of the intermediate layer is not greater than 58.

5. The multi-piece solid golf ball of claim 4, wherein the solid core is formed of a rubber composition blended with zinc oxide or barium sulfate, the amount of which is from 15.5 to 22.2 parts by weight per 100 parts by weight of the base rubber.

6. The multi-piece-solid golf ball of claim 4 wherein the intermediate layer is formed of material selected from ionomer resins, polyester elastomers, polyamide elastomers, styrene elastomers, polyurethane elastomers, olefin elastomers and mixtures of any, and rubbery materials.

* * * * *